United States Patent [19]

Dostal, Jr.

[11] 4,136,769

[45] Jan. 30, 1979

[54] DOOR OPERATING MECHANISM

[76] Inventor: Joseph Dostal, Jr., Rte. 2, Rice Lake, Wis. 54868

[21] Appl. No.: 802,910

[22] Filed: Jun. 2, 1977

[51] Int. Cl.[2] ..... B65G 15/60

[52] U.S. Cl. ..... 198/861; 198/735; 198/671; 49/104; 49/332; 222/506; 222/558

[58] Field of Search ..... 198/366, 369, 370, 671, 198/735, 860, 861; 49/104, 332, 339; 119/52 B, 52 AF, 56 R; 222/503, 506, 558; 251/284, 294

[56] References Cited

U.S. PATENT DOCUMENTS

| | | | |
|---|---|---|---|
| 1,044,388 | 11/1912 | Homer | 49/332 |
| 1,625,250 | 4/1927 | Ferguson | 49/104 |
| 1,902,675 | 3/1933 | Strevn | 198/370 |
| 2,501,743 | 3/1950 | Schellentrager | 222/503 |
| 3,275,125 | 9/1966 | Prentice | 198/671 |
| 3,333,573 | 8/1967 | Wotring | 119/52 AF |
| 3,774,751 | 11/1973 | Bakker | 119/56 R |
| 4,058,199 | 11/1977 | Schlagel | 198/370 |

FOREIGN PATENT DOCUMENTS

| | | | |
|---|---|---|---|
| 1433923 | 11/1966 | France | 198/735 |

*Primary Examiner*—Joseph E. Valenza
*Attorney, Agent, or Firm*—Allan O. Maki

[57] ABSTRACT

A mechanism for opening and shutting hinged doors, having special utility for discharge doors on silage elevators remotely operable by control ropes, which mechanism is firmly held in both open or closed position by gravity force holding the mechanism against a stop element which employ a door operating pulley, to one side of which is attached a control arm to open and close the door. The pulley is caused to rotate slightly past the point where said control arm is at its uppermost position when the door is opened and lowermost position when the door is closed and the stop means on said pulley prevents further rotation so that the door is held both open and shut by the force of gravity thereon.

6 Claims, 6 Drawing Figures

DOOR OPERATING MECHANISM

Various devices have been designed to open and shut hinged doors such as those used to start and stop the flow of silage or similar materials from a discharge shoot in an elevator. Where the door is not easily accessible by the operator thereof, remote control means such as lever, hydraulic cylinders, chains or ropes have been employed. One such mechanism which was previously employed involved the necessity of tieing a control rope onto a stationary object to hold the door in an open position.

It is an object of the present invention to provide a door opening and closing mechanism which can be operated with minimum effort. A further object is to provide a door mechanism operated by remote control by means of ropes which is simple and inexpensive to manufacture and easy to maintain. A further and important object is to provide such a mechanism which when pulled to either the open or closed position will remain in such position without the need for tieing or attaching a control rope or chain to some stationary object.

The present invention employs the principle of employing a rotary travelling device which moves over center and in which the weight of the door is applied in such fashion as to create a tendency for the device to continue travelling in and over center direction, in both the open and closed positions of the door. Such further travel in the over center direction is prevented, however, by appropriately arranged stop mechanisms which serve to limit the motion of the device and to thus hold the door stationary in either the open or closed position. The principal moving parts in the device of the present invention are:

(a) A simple pulley mechanism around which the control rope is wrapped;

(b) A connecting link pivotably attached to the controlled hinged door and rotatably attached to the side of the pulley adjacent the outer perimeter thereof;

(c) Stop means associated with the pulley to limit the rotation thereof in both clockwise and counterclockwise directions, and a control rope or chain wrapped around said pulley and having both ends extending therefrom for use by the operator in opening and closing the door.

The foregoing and other objects and advantages of the invention will become further evident from the specification and accompanying drawings, wherein.

Figure 4:
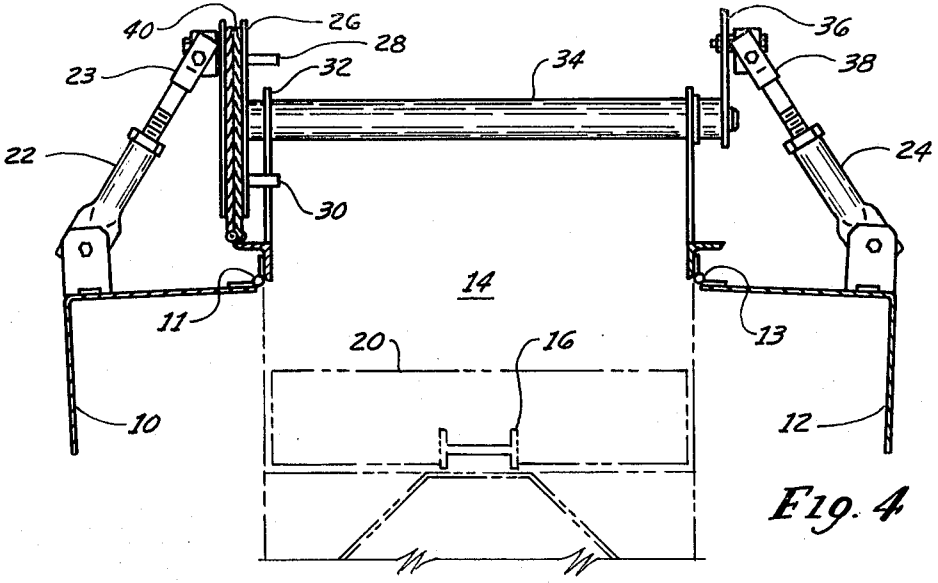
FIG. 4 is a cross-sectional view of the device of FIG. 3 taken along line B—B.

Referring specifically to the drawings, a pair of doors 10 and 12 is provided in the illustrated embodiment of the invention to provide a discharge opening in a conveyor duct 14 used to move solid materials such as animal feed from one location to another. Doors 10 and 12 are connected to the upper part of duct 14 by means of hinges 11 and 13. Inside duct 14 is a conventional chain mechanism 16 having cross-members 18 and 20 for pushing the solid material along within the duct.

Connecting arms 22 and 24 are hingedly connected to doors 10 and 12 respectively. The upper end of connecting arm 22 is pivotably and hingedly connected to the front side of pulley 26. The arm is so located on the pulley that the door will be closed when the arm passes the lowermost point on the pulley and is open to the maximum extent when the upper end of the connecting rod 22 passes the top of the pulley. On the rear side of pulley 26 are affixed stop pins 28 and 30.

Figure 3:
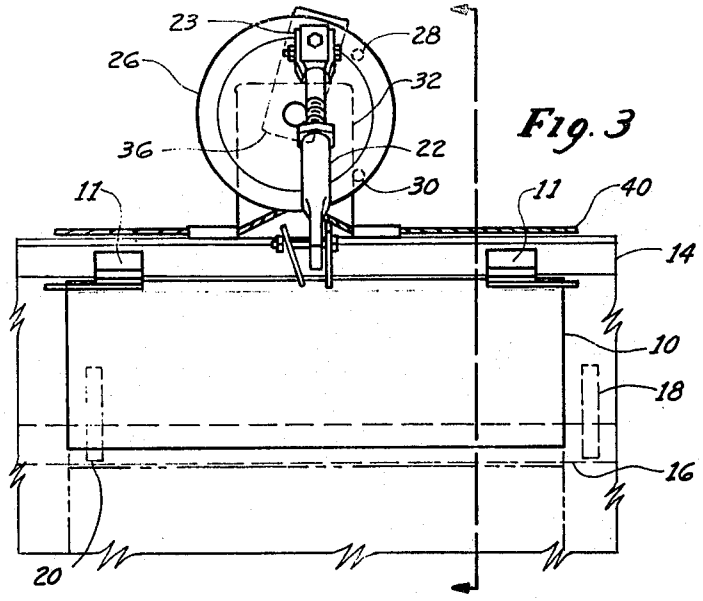
FIG. 3 is a front view of the door and door opening mechanism in the open position.
Figure 1:
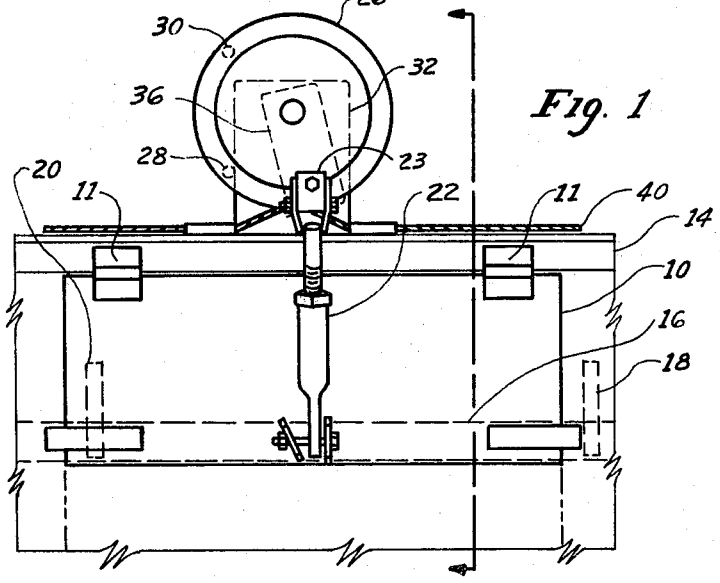
FIG. 1 is a front view of a door and door opening mechanism according to the invention in the closed position.

A stop plate 32 is located behind the pulley, and, by forming a means for pins 28 and 30 to strike as they rotate, serves to limit the rotation of the pulley. As seen in FIG. 1, pin 28 strikes the stop plate 32 shortly after pivotable connection 23 at the upper end of arm 22 has travelled slightly counterclockwise beyond its lowermost point of travel. As seen in FIG. 3, pin 30 strikes plate 32 slightly after pivotable connection 23 has travelled clockwise past the uppermost point of its travel and thus serves to limit clockwise rotation at this point.

Figure 2:
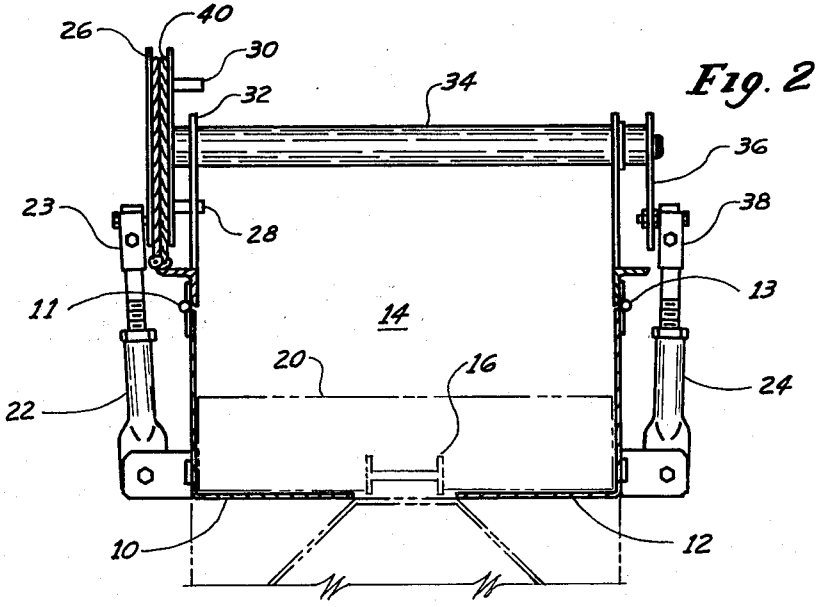
FIG. 2 is a cross-sectional view of the device of FIG. 1 taken along line A—A.

As seen in FIG. 2 and FIG. 4, a shaft 34 is rigidly affixed to the central portion of pulley 26. The pulley 26 and shaft 34 rotate together in the illustrated embodiment. However, if a single door were used, it will be apparent that pulley 26 could be rotatable on shaft 34. To the other end of shaft 34 is rigidly affixed an arm 36 to which is pivotably connected the upper end of connecting arm 24. Arm 36 is so positioned that pivotable connections 28 and 38 are in alignment. Thus doors 10 and 12 will be opened and closed simultaneously.

Around the periphery of pulley 26 is wound a rope or similar elongated means 40 which could be a chain, plastic strand, cable, or similar means. Each end of rope 40 extends outwardly from pulley 26 and by means of auxiliary pulleys may be extended to some common location. In cases where duct 14 is elevated it is desirable to have the ends of rope 40 extend to a position near the floor so that the doors 10 and 12 are conveniently opened and closed by remote control.

In operation, the operator opens the door by pulling the left end of the rope as viewed in FIG. 1. The rope is pulled until the pulley has been rotated to the position shown in FIG. 3 where further rotation in the clockwise direction is prevented by pin 30 engaging plate 32. Since the weight of doors 10 and 12 pulls downward on arms 22 and 24 the force of gravity pushes the pulley in a clockwise direction as seen in FIG. 1 and FIG. 3 and thus the door remains stationary in an open position without need for tieing or attaching rope 40 to any other means.

To close the doors, one pulls the right-hand end of the ropes as viewed in FIG. 1 and FIG. 3 to rotate the pulley counterclockwise. As previously noted, stop 28 limits the counterclockwise rotation at a point where the pivotable joints 23 and 38 have passed slightly in the counterclockwise direction beyond their lowermost point. The weight of the doors tends to continue the counterclockwise rotation particularly if there is silage or other comminuted solid material within the duct against the inside of the doors. Thus the doors remain stationary in the closed position as well as in the open position.

As indicated arms 22 and 24 may be provided with adjustability by forming them in two parts which are threaded or otherwise adjustably fastened together.

The mechanism of this invention has particular utility when utilized as a means for opening and closing doors on silage conveyors. However, it will be apparent to those skilled in the art that many additional uses are possible. For example, where conveyors are used for transport of particulate plastic material, for example, in an industrial process, the doors of this invention would provide a convenient arrangement for opening and shutting such doors. Thus the devices of the present invention have wide application for a large number of agricultural and industrial uses.

It will be readily apparent to those skilled in the art that various design modifications may be made of the mechanism of this invention without departing from the true scope thereof. Therefore, it is to be understood that the specific details of the construction disclosed herein are for the purpose of illustration, and not limitation, except as made necessary by the scope of the appended claims.

Figure 6:
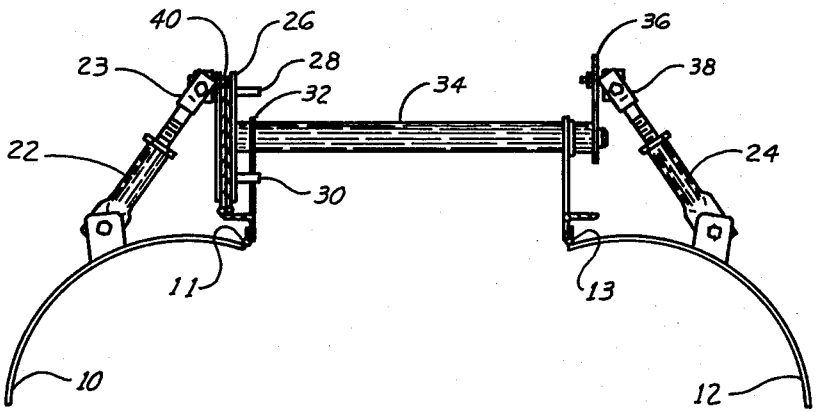
FIGS. 5 and 6 illustrates the use of the mechanism of the present invention in conjunction with curved doors. Other than the configuration of the doors the operation of the device is identical to that in the foregoing description and thus these figures are self-explanatory.
Figure 5:
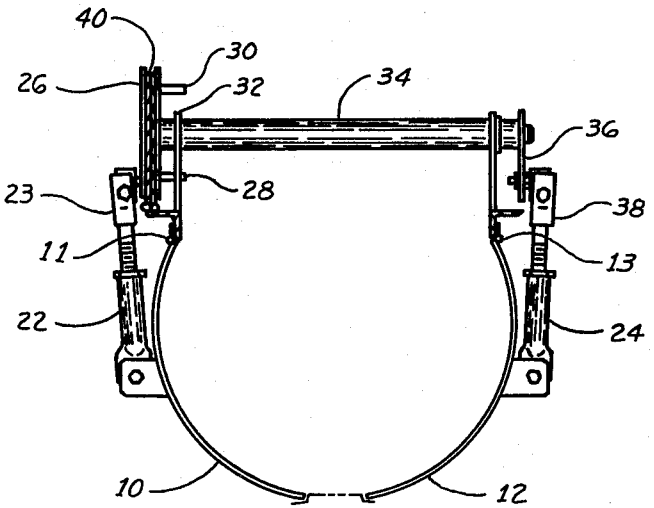

One alternative embodiment shown in FIGS. 5 and 6 is where doors are desired for use in connection with an auger system having a circular cross-section the mechanism of the present invention is readily adapted thereto. In such cases, instead of using an "L" shaped door the door itself will usually be curved to match the circular contour of the auger. In other respects the balance of the mechanism can be used as illustrated.

What is claimed is:

1. In combination a hinged door and a mechanism for opening and closing said door comprising:

(a) a door having a hinge at the top edge thereof;

(b) a pulley located above said door;

(c) a connecting rod hingedly connected on one end to said door and pivotably connected to a peripheral edge of said pulley at opposite end;

(d) stop means associated with said pulley to limit rotation thereof in both the clockwise and counterclockwise directions located so as to allow rotation of said pulley in one direction slightly past the point where said pivotable connection is at its lowermost point of travel and in the opposite direction slightly past its uppermost point of travel;

(e) an elongated flexible means wrapped around said pulley suitable for causing rotation thereof in each direction.

2. A device according to claim 1 wherein said door is of an L shaped configuration.

3. A device according to claim 1 wherein said elongated flexible means is a rope.

4. A device according to claim 1 wherein said rod is connected to the front face of said pulley and said stop means comprising pins extending from the rear face thereof together with a metal plate positioned to intercept one of said pins to limit clockwise travel and the other of said pins to limit counterclockwise travel.

5. In combination, a pair of hinged doors adapted to open and close a section of a material conveying duct and a mechanism for opening and closing said doors comprising:

(a) a door hinged at the top edge thereof;

(b) a pulley located above a first door;

(c) a connecting rod hingedly connected on one end to said door and pivotably connected to a peripheral edge of said pulley at opposite end;

(d) stop means associated with said pulley to limit rotation thereof in both the clockwise and counterclockwise directions located so as to allow rotation of said pulley in one direction slightly past the point where said pivotable connection is at its lowermost point of travel and in the opposite direction slightly past its uppermost point of travel;

(e) an elongated flexible means wrapped around said pulley suitable for causing rotation thereof in each direction;

(f) said pulley being rigidly attached to a central shaft extending from the side of the pulley opposite said connecting rod, said shaft being pivotably attached at the opposite end to a second connecting rod, said pivotable connection being attached to a radially offset member which is rigidly affixed to said opposite end of said shaft and aligned with the first mentioned pivotable connection;

(g) a second door also being hinged at the top edge thereof, the end of said second connecting rod opposite said pivotable connection being hingedly connected to said second door whereby said doors are simultaneously opened and simultaneously closed by rotation of said pulley.

6. A device according to claim 1 wherein said door is of a curved configuration.

* * * * *